US010559931B2

(12) United States Patent
Reed

(10) Patent No.: US 10,559,931 B2
(45) Date of Patent: Feb. 11, 2020

(54) HIGH CIRCUIT COUNT ELECTRICAL CONNECTOR

(71) Applicant: Ford Global Technologies, LLC, Dearborn, MI (US)

(72) Inventor: Glenn Richard Reed, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/960,098

(22) Filed: Apr. 23, 2018

(65) Prior Publication Data

US 2019/0326714 A1 Oct. 24, 2019

(51) Int. Cl.

| | |
|---|---|
| ***H01R 24/58*** | (2011.01) |
| ***H01R 33/76*** | (2006.01) |
| ***H01R 13/508*** | (2006.01) |
| ***H01R 107/00*** | (2006.01) |

(52) U.S. Cl.

CPC ..... *H01R 24/58* (2013.01); *H01R 13/508* (2013.01); *H01R 33/7635* (2013.01); *H01R 2107/00* (2013.01); *H01R 2201/26* (2013.01)

(58) Field of Classification Search

CPC .. H01R 24/58; H01R 13/508; H01R 33/7635; H01R 2107/00; H01R 2201/26; H01R 35/025; H01R 35/04; H01R 39/64

USPC ..... 439/10, 11, 13, 18, 31

See application file for complete search history.

(56) References Cited

U.S. PATENT DOCUMENTS

| | | | | | |
|---|---|---|---|---|---|
| 2,749,526 | A * | 6/1956 | Petersen | H01R 13/22 | 29/881 |
| 2,892,990 | A * | 6/1959 | Werndl | H01R 13/193 | 200/19.06 |
| 3,076,163 | A | 1/1963 | Nodge et al. | | |
| 3,193,636 | A * | 7/1965 | Daniels | H01R 24/58 | 191/12 R |
| 3,665,509 | A * | 5/1972 | Elkins | H01R 13/523 | 439/271 |
| 3,838,234 | A | 9/1974 | Peterson | | |
| 3,860,312 | A | 1/1975 | Ordon, Jr. | | |
| 4,421,371 | A * | 12/1983 | Clark | H01R 13/631 | 439/249 |
| 4,640,570 | A * | 2/1987 | Strate | H01R 13/631 | 439/271 |
| 5,409,403 | A * | 4/1995 | Falossi | H01R 24/38 | 439/21 |

(Continued)

FOREIGN PATENT DOCUMENTS

| | | |
|---|---|---|
| CN | 205330335 U | 6/1916 |
| KR | 101214296 B1 | 12/2012 |

*Primary Examiner* — Oscar C Jimenez

(74) *Attorney, Agent, or Firm* — Frank Lollo; Eversheds Sutherland (US) LLP

(57) ABSTRACT

Embodiments provide an electrical connector having the ability for a high circuit count. An example electrical connector includes a plurality of contact traces extending along a circumference of a tapered post, on a plurality of respective planes perpendicular to a post axis. The electrical connector also includes a tapered cup positioned over the tapered post, having a plurality of inward facing terminal contacts corresponding to the plurality of contact traces, wherein the terminal contacts are configured to maintain contact as the tapered cup rotates about the post axis.

20 Claims, 4 Drawing Sheets

(56) References Cited

U.S. PATENT DOCUMENTS

| | | | | |
|---|---|---|---|---|
| 6,530,784 | B1 * | 3/2003 | Yim | G06F 1/1616 361/679.29 |
| 9,203,184 | B1 * | 12/2015 | Hui | H01R 13/629 |
| 9,496,638 | B1 * | 11/2016 | Su | H01R 4/363 |
| 9,620,896 | B1 * | 4/2017 | Dubbaka | H01R 13/631 |
| 9,685,742 | B2 * | 6/2017 | Liu | H01R 13/713 |
| 10,185,369 | B1 * | 1/2019 | Yu | G06F 1/1683 |
| 10,224,654 | B1 * | 3/2019 | Su | H01R 12/777 |
| 2002/0112320 | A1 | 8/2002 | Hayashi | |
| 2004/0038719 | A1 * | 2/2004 | Lee | G06F 1/1616 455/575.7 |
| 2011/0053386 | A1 * | 3/2011 | Li | H01R 39/64 439/49 |
| 2014/0220790 | A1 * | 8/2014 | Lee | E05D 11/0081 439/31 |
| 2015/0099391 | A1 * | 4/2015 | Hashimoto | H01R 13/631 439/380 |
| 2017/0179631 | A1 * | 6/2017 | Feldchtein | H01R 13/44 |
| 2018/0013227 | A1 * | 1/2018 | Arditty | G02B 6/3816 |
| 2018/0013228 | A1 * | 1/2018 | Arditty | H01R 13/5216 |

* cited by examiner

HIGH CIRCUIT COUNT ELECTRICAL CONNECTOR

TECHNICAL FIELD

This application relates to an electrical connector for use in a vehicle, in particular near a position connecting the door to the body of the vehicle or where a body panel rotates relative to another, such as any hinged closure.

BACKGROUND

When installed, electrical wiring may include bends to navigate about various obstacles and may be required to flex when routed between components that rotate relative to each other when mounted with hinges. For example, wiring installed in a vehicle may provide connections between components located in the vehicle doors and a central processor. This wiring may thus be required to bend regularly about the hinge as the vehicle doors are opened and closed.

SUMMARY

The appended claims define this application. The present disclosure summarizes aspects of the embodiments and should not be used to limit the claims. Other implementations are contemplated in accordance with the techniques described herein, as will be apparent to one having ordinary skill in the art upon examination of the following drawings and detailed description, and these implementations are intended to be within the scope of this application.

Example embodiments are shown describing systems and apparatuses for connecting electrical wires together, in particular where the wiring must traverse a hinge or rotational axis. An example electrical connector includes a plurality of contact traces extending along a circumference of a tapered post, on a plurality of respective planes perpendicular to a post axis. The electrical connector also includes a tapered cup positioned over the tapered post, having a plurality of inward facing terminal contacts corresponding to the plurality of contact traces, wherein the terminal contacts are configured to maintain contact as the tapered cup rotates about the post axis.

Another example electrical connector includes a tapered post having a plurality of outward facing terminal contacts on a plurality of respective planes perpendicular to a post axis. The electrical connector also includes a tapered cup positioned over the tapered post having a plurality of contact traces corresponding to the plurality of terminal contacts, extending along an inner circumference of the tapered cup, wherein the terminal contacts are configured to maintain contact as the tapered cup rotates about the post axis.

BRIEF DESCRIPTION OF THE DRAWINGS

For a better understanding of the invention, reference may be made to embodiments shown in the following drawings. The components in the drawings are not necessarily to scale and related elements may be omitted, or in some instances proportions may have been exaggerated, so as to emphasize and clearly illustrate the novel features described herein. In addition, system components can be variously arranged, as known in the art. Further, in the drawings, like reference numerals designate corresponding parts throughout the several views.

DETAILED DESCRIPTION OF EXAMPLE EMBODIMENTS

Figure 1:
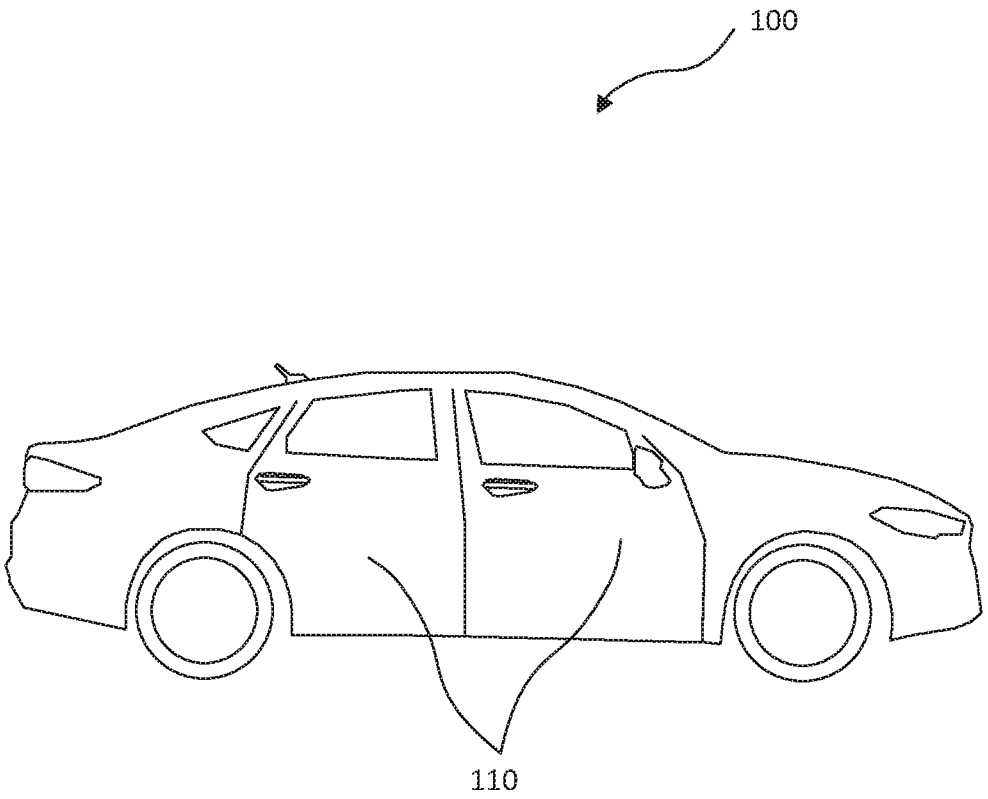
FIG. 1 is an example vehicle that may make use of the electrical connectors described herein.

While the invention may be embodied in various forms, shown in the drawings and hereinafter described are some exemplary and non-limiting embodiments, with the understanding that the present disclosure is to be considered an exemplification of the invention and is not intended to limit the invention to the specific embodiments illustrated.

As noted above, wiring may sometimes be used in situations where it must traverse a moving part, such as a hinge. For instance, vehicle doors often include switches, lights, sensors, and other electrical components that require a connection to a processor, power source, or other electrical device or system that is not located in the door. To connect these components, electrical wiring may be routed from the body of the vehicle through grommets in the door and vehicle body, positioned near the axis of the door hinge. The wires are then free to flex and bend as the door is opened and closed during normal use of the vehicle.

This setup can have several issues. For example, when wiring is routed inside grommets, burrs or rough surfaces may be present on the inside of the grommet which can cause fraying or other wear-and tear on the wires. Further, gaps may be present that can result in leaks or water entering the wiring area, which can cause corrosion and other ill effects. In addition, an increased number of wires being used can cause greater stress on the wiring during opening and closing of the door, which can lead to wire breakage and reduced reliability and robustness.

With these issues in mind, example embodiments disclosed herein may include making use of an electrical connector comprising separable components. Examples disclosed herein may be described with reference to a connector of wires between a vehicle door and body, however it should be noted that the connector described herein may be used in any location of the vehicle in which wires pass through a rotational axis, such as in a mechanism connecting the trunk of the vehicle to the body or a rotating seat. Further, it should be understood that the electrical connector disclosed herein may be used in other contexts aside from vehicle, in particular contexts in which a rotational axis is present over which the wiring must be connected.

Using a vehicle door as an example, an electrical connector of the present disclosure may include a body-side harness and a door-side harness with a floating pivot about the door hinge axis, allowing for the elimination of the door grommet. The electrical connector can be attached before or after the door is hung on the vehicle body, and also allows the door to be easily attached and removed without needing to re-wire. Further, the electrical connector disclosed herein allows for smaller gauge wires and thus increased wire density or "circuit count," because the wiring does not flex during open and close cycling of the door. Rather, the connector itself rotates, and allows the wires to remain fixed with respect to the rotating elements. As such, the wires do not experience the wear and tear typical of a connection through the door hinge, and thus smaller gauge wires and increased circuit counts can be used.

The example electrical connector may include a tapered post over which a floating tapered cup is placed. The post may include contact traces, and the cup may include inward facing terminal contacts that, when the two parts are connected or attached, allow the electrical connection to pass from the post to the cup. The tapered post may have a post axis, and the contact traces may be perpendicular to the post axis. When the cup rotates, the terminal contacts may maintain contact with the contact traces. The post and cup may be tapered in the same or similar manner, such that when the cup is place onto the post, the inward facing terminal contacts do not scratch or deform when the cup is lowered onto the post. Rather, the taper may ensure that each terminal contact touches the corresponding contact trace on the post at the same time. The cup may then be configured to rotate with respect to the post as the door is opened or closed. The post and cup may also include a housing configured to protect the post and cup.

FIG. 1 illustrates an example vehicle 100 that may include the electrical connector described herein. Vehicle 100 may include one or more doors 110, which may each include one or more sensors, switches, lights, or other electrical components that require wiring that couples to a central processor of the vehicle through the door/body of the vehicle.

Figure 2:
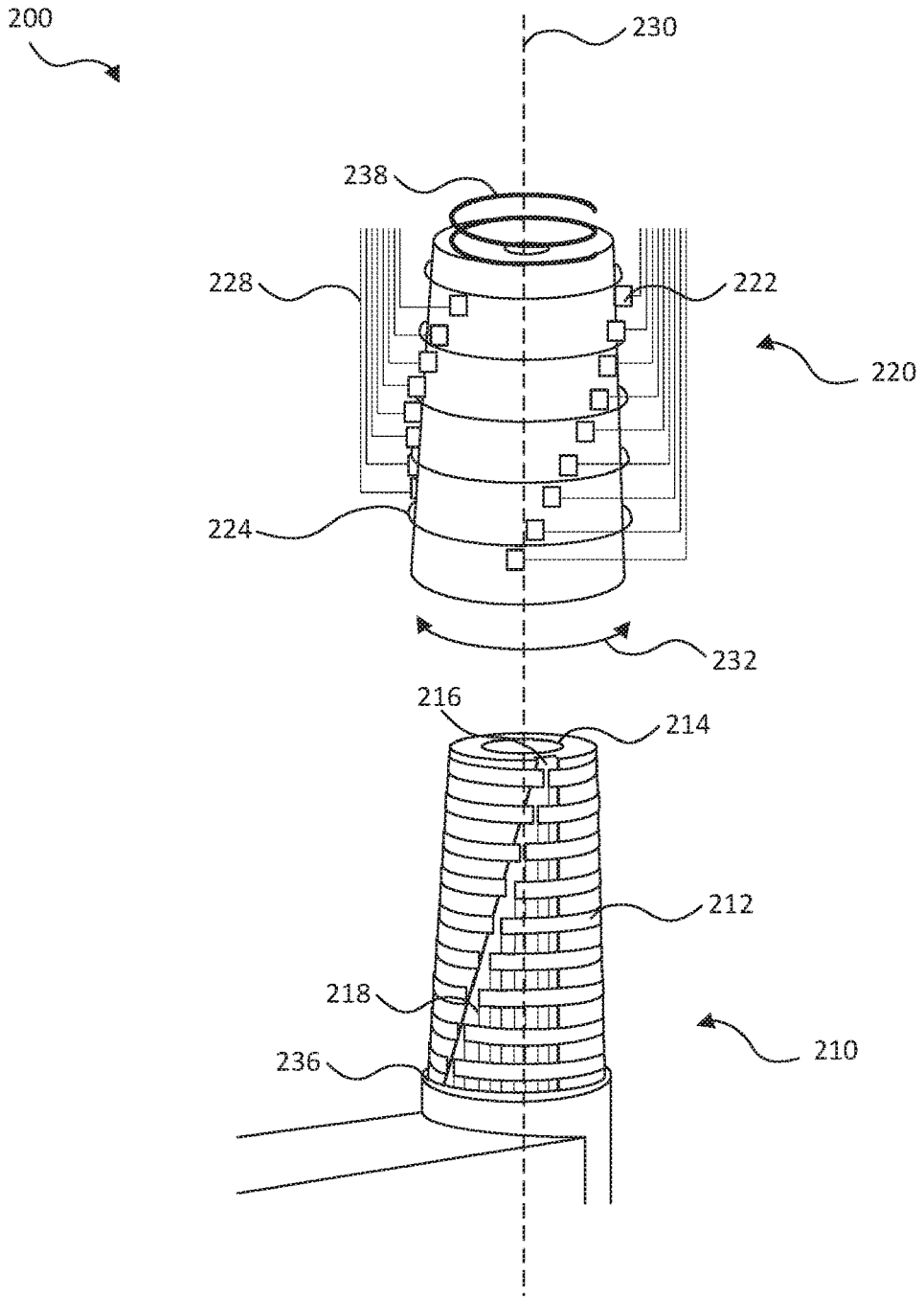
FIG. 2 is a perspective view of an example electrical connector post and cup in an unattached state, according to embodiments of the present disclosure.

FIG. 2 illustrates an example electrical connector 200 comprising a tapered post 210 and a tapered cup 220. Tapered post 210 may be cylindrical or substantially cylindrical as illustrated in FIG. 2, and may have one end with a larger diameter than the other end. In FIG. 2, the bottom has a larger diameter than the top end. Tapered post 210 may include a plurality of contact traces 212 extending along an outer circumference of the tapered post. The contact traces may be any conductive material, and may be shaped to generally follow the curve of the post 210. In some examples, each contact trace 212 may be rectangular, and attached to an outer surface of the post 210.

The plurality of contact traces 212 may extend on a plurality of respective planes perpendicular to post axis 230. As shown in FIG. 2, the planes may be spaced evenly along the post axis 230. However, it should be noted that the planes may not be evenly spaced in all cases. One set of contact traces 212 may be spaced closer together than another set. In some examples, a non-conductive or insulating portion may be positioned between adjacent contact traces, so as to prevent interference or unintentional contact between traces.

In some examples, a given plane perpendicular to the post axis 230 may include only one contact trace 212, which may extend around an entire circumference (e.g., approximately 360 degrees) of the tapered post. One or more planes may include multiple contact traces end to end around the circumference of the post 210. In these cases, each contact trace may extend around a portion of the tapered post 210. Where multiple traces are positioned in same plane, the multiple traces may be evenly distributed (e.g., such that each contact trace covers the same circumferential distance, albeit offset from the other traces in the plane), or they may be unevenly distributed (e.g., such that one contact trace covers a larger circumferential distance than another in the same plane).

In some examples, all planes may include the same number of contact traces. In other examples, some plane(s) may include a single trace, while other plane(s) include two or more traces. The number of contact traces per plane may correspond to an amount of rotation expected during use of the connector, or a limit provided by the physical use of the electrical connector. For instance, if the connector is intended for use in a door hinge that is limited from opening greater than 90 degrees, each contact trace in a given plane may be configured to cover 90 degrees of the circumference of the post as well. In some examples, a buffer may be included to allow for slight differences (e.g., for an electrical connector used in a door that will open to 90 degrees, a given plane may include three traces per plane, each covering approximately 120 degrees of the outer circumference of the tapered post).

In some examples, the tapered post 210 may include a spacing between traces in same plane. Planes on which the contact traces 212 are positioned may be perpendicular to post axis 230, such that they are parallel to a rotation axis 232 of cup 220 when the electrical connector 200 is fully assembled.

In some examples, tapered post 210 may include a channel 216, positioned on an outside surface of the tapered post 210, but inside the contact traces 210, as shown in FIG. 2. Channel 216 may be configured to align the wires 218 coupled to the contact traces 212. The wires 218 may be positioned inside the channel 216 such that each wire can travel from its respective contact trace toward a bottom end of the post 210. In some examples, channel 216 may be generally triangular or trapezoidal in shape, such that a top portion is more narrow than a bottom portion, as shown in FIG. 2.

In some examples, tapered post 210 may include a single channel 216. In other examples, tapered posted 210 may include two or more channels. Where multiple channels are included, they may be positioned symmetrically or asymmetrically around the outer surface of the tapered post 210. The number of channels included may correspond to the number of contact traces included on each plane (or in any given plane), such that there are two channels where the post includes two traces per plane, three channels where there are three traces per plane, etc.

In some examples, the contact traces 212 may be axially or angularly indexed with respect to the post axis 230, as shown in FIG. 2. Each trace 212 may have a first end and a second end, and the first end of a given contact trace may be offset slightly along the circumference of the post 210 from a second contact trace in an adjacent plane. This may allow for a greater number of contact traces to be used in a smaller form factor, by allowing the wires 218 to couple to the end of the traces and travel straight down the channel 216 without running into wires from adjacent contact traces.

The tapered post 210 may also include a ring, seal, gasket, or other sealing member 236 positioned at a base of the post. The sealing member 236 may be configured to contact the tapered cup 220 when the electrical connector is fully assembled, and may prevent water, dirt, or other materials from entering and interfering with the operation of the electrical connector 200.

Further, tapered post 210 may include a bore hole 214 positioned in a center of the tapered post along the post axis 230. The bore hole may allow the cup 220 to be positioned onto the post, via a boss of the cup. This is shown and described in further detail with respect to FIGS. 4A and 4B below.

Electrical connector 200 also includes a tapered cup 220. The tapered cup 220 may be configured such that it can be positioned over the tapered post and centered around the post axis 230. The taper of the tapered cup 220 may be matched to the taper of the post 210. In some examples, the tapered cup 220 may be larger than the tapered post 210.

In some examples, the tapered cup may include a plurality of inward facing terminal contacts 222. These terminal contacts may have an inner side and an outer side. The outer side of the plurality of terminal contacts 222 may be coupled to the wires 228. And the inner side of the plurality of terminal contacts 222 may be configured to engage the contact traces 212 of the tapered post 210. As such, the terminal contacts 222 may be positioned on the tapered cup 220 such that they correspond to the contact traces 212 on the post 210.

The terminal contacts 222 may be spring contacts, configured to press against the contact traces 212. As such, the terminal contacts 222 may be configured to engage the contact traces 212 and maintain that engagement when the cup is rotated about the rotational axis 232 when the electrical connector is fully assembled.

In some examples, the terminal contacts 222 may be axially or angularly indexed to correspond to indexing of contact traces 212. This is illustrated in FIG. 2. Each contact trace may correspond to one terminal contact. As such, where there are multiple contact traces in a given plane, there may also be multiple terminal contacts on the cup in the same plane.

In some examples, the tapered cup 220 may include one or more outward facing rib sections 224. The rib sections 224 may be configured to align terminal contacts 222, so as to ensure that the wires 228 coupled to the terminal contacts are secure and facing the proper direction. Terminal contacts 222 may be ordinarily configured to rotate when seated in the cup 220 (i.e., rotating perpendicular to the post axis 230). The rib sections 224 may be configured to abut the outer side of the terminal contacts, to prevent them from rotating perpendicular to the post axis 230. As such, wiring 228 coupled to the terminal contacts 222 may be prevented from rotating or moving with respect to the tapered cup 230 as well.

The spring 238 may be coupled to the tapered cup 220 on one end, and a housing (shown in FIG. 3) on a second end, so as to bias the cup into full engagement with the tapered post when the electrical connector is assembled. The spring 238 may prevent the cup from moving up and down the post axis 230 and causing issues with improper connection or misalignment.

Figure 3:
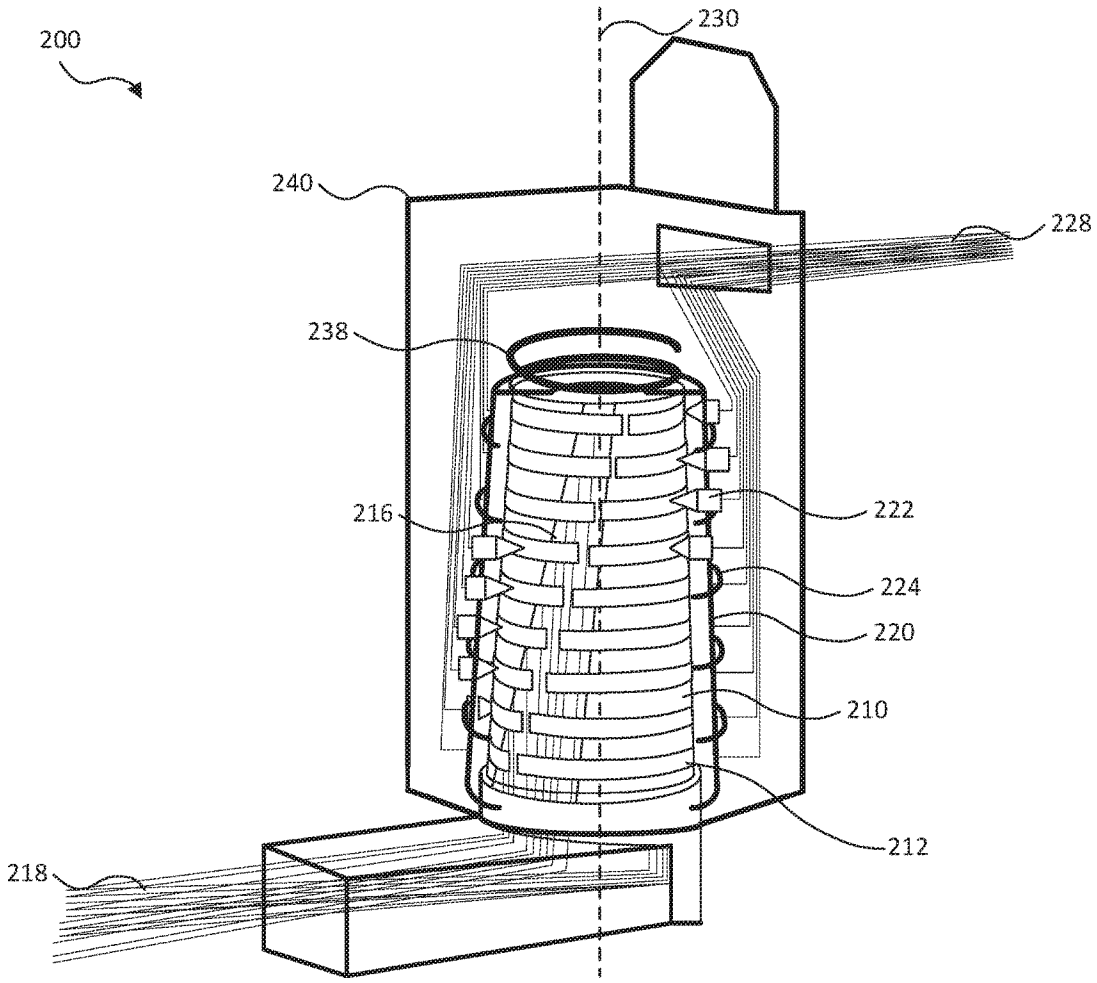
FIG. 3 is a cross-section view of an example electrical connector in a housing, according to embodiments of the present disclosure.

FIG. 3 illustrates a cross-section view of the example electrical connector 200 in an assembled state. The electrical connector 200 includes a tapered post 210, a tapered cup 220, and a housing 240. As described above, the tapered post 210 includes a plurality of contact traces 212, positioned along the outer circumference of the post 210 in a plurality of respective planes that are perpendicular to the post axis. The cup 220 includes a plurality of terminal contacts 222 corresponding to the contact traces 212. Each of the plurality of wires 218 corresponds to a contact traces 212. Further, each of the wires 228 corresponds to a terminal contact 222.

The electrical connector 200 is configured such that post 210 and cup 220 can rotate with respect to each other about the post axis 230. Rotation of the cup 220 with respect to the post 210 can allow the wires 218 and 228 to remain stationary with respect to the post 210 and cup 220. As such, electrical connector 200 allows voltage, current, data, and any other electrical signals to be transmitted between wires 218 and 228 without requiring any bending or flexing of the wires. As the cup 220 rotates, the terminal contacts 222 maintain their engagement with the contact traces 212, ensuring a stable connection.

FIG. 3 also illustrates that the spring 238 may be configured to maintain the cup 220 in the appropriate attached or assembled position with respect to the post 210. The spring 230 may be a compression spring having a first end coupled to the housing 240, and a second end coupled to the cup 220. may be configured to push the cup 220 down onto the post 210 to maintain a proper fitting and alignment of the contact traces 212 and terminal contacts 222.

Where the electrical connector 200 is installed for use in a vehicle door, the housing 240 may be coupled to the vehicle door and/or body at one or more points. The placement of the electrical connector may be such that the post axis 230 is positioned on a hinge axis of a vehicle door (i.e., the post axis and the hinge axis are the same). In this configuration, the housing may be attached to the door such that when the door is rotated to open or close, the cup 220 rotates as well.

Figure 4A:
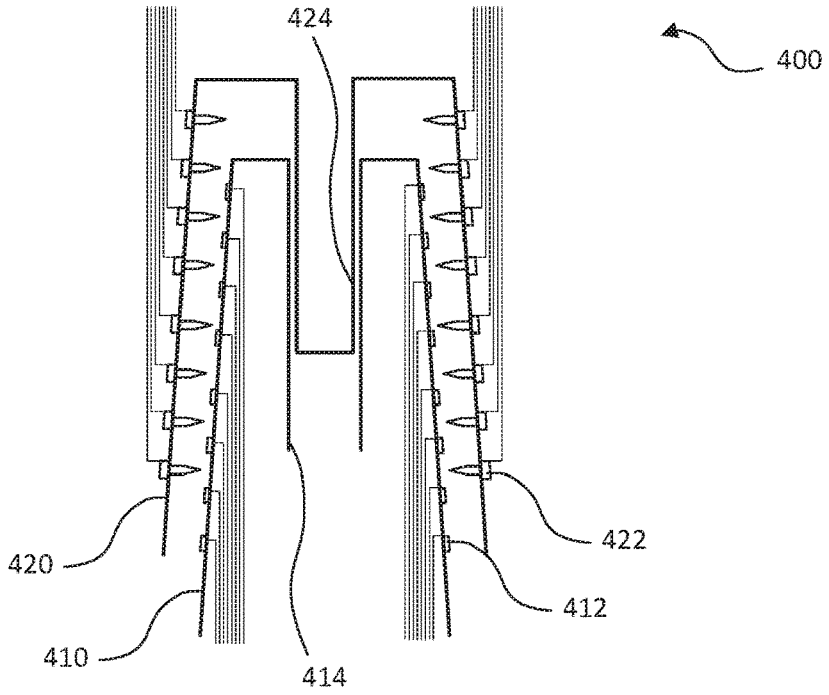
FIGS. 4A and 4B illustrate cross-section views of an example electrical connector in a partially attached and attached state.
Figure 4B:
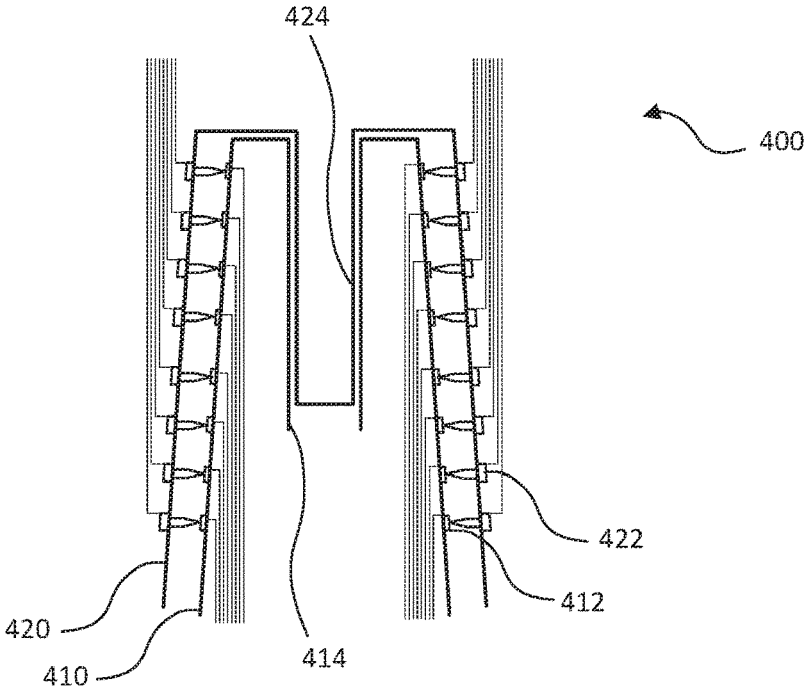

FIGS. 4A and 4B illustrate two cross-section views of an example electrical connector 400 of the present disclosure. Electrical connector 400 may be similar or identical to electrical connector 200 in one or more respects. FIGS. 4A and 4B show a simplified cross-section view of the electrical connector 400 in a first state in which the cup 420 is partially attached to the post 410 (FIG. 4A) and a second state in which the cup 420 is fully attached to the post 410 (FIG. 4B).

Electrical connector 400 includes a tapered post 410, having a plurality of contact traces 412 extending around the circumference of the post 410 (i.e., into and out of the page in FIGS. 4A and 4B as shown). The tapered cup 420 includes a plurality of terminal contacts 422, each corresponding to a contact trace 412 of the tapered post 410.

Tapered post 410 also includes a bore hole 414 in the center of the post. The tapered cup 420 includes a boss 424, which aligns with the bore hole 414. When the tapered cup 420 is positioned onto the tapered post 410, the boss 424 aligns with and is inserted into the bore hole 414, to ensure that the post and cup are centered and aligned properly.

FIGS. 4A and 4B also illustrate the electrical connector in a first, partially attached position, and a second, attached position. These positions illustrate that the plurality of terminal contacts 422 are configured such that they all engage the plurality of contact traces 412 at the same time when the cup 420 is positioned on the post 410 (e.g., the attached position). The taper of the cup and post ensure are configured such that the terminal contacts at a bottom end of the cup are spaced further away from the post axis, while the terminal contacts at the top end of the cup are closer to the post axis. The contact traces on the post are similarly further away from the post axis on the bottom end of the post, while being closer to the post axis on the top end of the post. This configuration allows the cup to be positioned on the post from the top down, and avoid having the terminal contacts on the bottom end rub against or bump into contact traces as the cup is lowered onto the post.

In some examples, the plurality of contact traces may be disposed on a flexible circuit, rather than individual components. The flexible circuit may be shaped to curve around the circumference of the tapered post, and may include contact traces on a plurality of planes perpendicular to the post axis.

The electrical connectors described above have been disclosed such that the post includes the plurality of contact traces, and the cup includes the plurality of corresponding terminal contacts. However, it should be noted that in some examples the reverse may be true—the post may include the terminal contacts while the cup includes the contact traces.

An example electrical connector may include a tapered post having a plurality of outward facing terminal contacts on a plurality of respective planes perpendicular to a post axis. The electrical connector may also include a tapered cup positioned over the tapered post having a plurality of contact traces corresponding to the plurality of terminal contacts, extending along an inner circumference of the tapered cup, wherein the terminal contacts are configured to maintain contact as the tapered cup rotates about the post axis.

In this arrangement, the post may include one or more channels configured to align the wiring coupled to the plurality of terminal contacts. And the cup may include one or more outward facing rib sections configured to align wiring coupled to the plurality of contact traces.

Further, the descriptions above with respect to the number of contact traces per plane may apply to the inward facing contact traces on the cup.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects. Further, the conjunction "or" may be used to convey features that are simultaneously present instead of mutually exclusive alternatives. In other words, the conjunction "or" should be understood to include "and/or". The terms "includes," "including," and "include" are inclusive and have the same scope as "comprises," "comprising," and "comprise" respectively.

The above-described embodiments, and particularly any "preferred" embodiments, are possible examples of implementations and merely set forth for a clear understanding of the principles of the invention. Many variations and modifications may be made to the above-described embodiment(s) without substantially departing from the spirit and principles of the techniques described herein. All modifications are intended to be included herein within the scope of this disclosure and protected by the following claims.

I claim:

1. An electrical connector comprising: a plurality of contact traces extending along a circumference of a tapered post, on a plurality of respective planes perpendicular to a post axis; and a tapered cup positioned over the tapered post, having a plurality of inward facing terminal contacts corresponding to the plurality of contact traces, wherein the terminal contacts are configured to maintain contact as the tapered cup rotates about the post axis, wherein the tapered post comprises a plurality of channels corresponding to a number of contact traces on the plurality of respective planes, wherein the plurality of channels are positioned on an outside surface of the tapered post and configured to align wiring coupled to the plurality of contact traces, wherein the outside surface corresponds to an outer circumference of the tapered post, and wherein a first plane of the plurality of respective planes comprises a different number of contact traces than a second plane of the plurality of respective planes.

2. The electrical connector of claim 1, wherein the post axis is a hinge axis of a vehicle door, and wherein rotating the vehicle door causes the tapered cup to rotate.

3. The electrical connector of claim 1, wherein the tapered cup is configured to move from a partially attached position to an attached position, such that in the attached position the plurality of inward facing terminal contacts engage the plurality of contact traces, and wherein in the partially attached position none of the plurality of inward facing terminal contacts engage the plurality of contact traces.

4. The electrical connector of claim 1, wherein the plurality of channels are more narrow at a top end of the channels than at a bottom end of the channels located at a bottom end of the tapered post.

5. The electrical connector of claim 1, wherein the tapered cup comprises one or more outward facing rib sections configured to align wiring coupled to the plurality of inward facing terminal contacts.

6. The electrical connector of claim 1, wherein the terminal contacts comprise spring contacts.

7. The electrical connector of claim 1, wherein the contact traces are angularly indexed with respect to the post axis, wherein one end of a first contact trace is offset from a second contact trace in an adjacent plane along the circumference of the tapered post.

8. The electrical connector of claim 1, wherein the tapered post defines a bore hole, and wherein the tapered cup comprises a boss configured to insert into the bore hole.

9. The electrical connector of claim 1, wherein one or more of the plurality of respective planes includes two or more contact traces, each extending along a separate respective portion of the circumference of the tapered post.

10. The electrical connector of claim 9, wherein each of the plurality of respective planes includes only three contact traces extending end-to-end along the circumference of the tapered post.

11. The electrical connector of claim 1, further comprising a housing and a compression spring, wherein a first end of the compression spring is coupled to the housing, and a second end of the compression spring is coupled to the tapered cup, such that the compression spring biases the tapered cup onto the tapered post.

12. The electrical connector of claim 1, wherein the plurality of contact traces are disposed on a flexible circuit, wherein the flexible circuit is configured to wrap around the tapered post.

13. An electrical connector comprising: a tapered post having a plurality of outward facing terminal contacts on a plurality of respective planes perpendicular to a post axis; and a tapered cup positioned over the tapered post having a plurality of contact traces corresponding to the plurality of terminal contacts, extending along an inner circumference of the tapered cup, wherein the terminal contacts are configured to maintain contact as the tapered cup rotates about the post axis, wherein a first plane of the plurality of respective planes comprises a different number of contact traces than a second plane of the plurality of respective planes, wherein the contact traces are angularly indexed with respect to the post axis, wherein one end of a first contact trace is offset along the circumference of the tapered post from a second contact trace in an adjacent plane, and wherein one or more of the plurality of respective planes corresponds to two or more contact traces, each extending along a separate respective portion of the inner circumference of the tapered cup.

14. The electrical connector of claim 13, wherein the tapered cup is configured to move from a partially attached position to an attached position, such that in the attached position the plurality of terminal contacts engage the plurality of contact traces, and wherein in the partially attached position none of the plurality of terminal contacts engage the plurality of contact traces.

15. The electrical connector of claim 13, wherein the tapered post comprises one or more channels configured to align wiring coupled to the plurality of terminal contacts.

16. The electrical connector of claim 13, wherein the tapered cup comprises one or more outward facing rib sections configured to align wiring coupled to the plurality of contact traces.

17. The electrical connector of claim 13, wherein the tapered post defines a bore hole, and wherein the tapered cup comprises a boss configured to insert into the bore hole.

18. The electrical connector of claim 13, further comprising a housing and a compression spring, wherein a first end of the compression spring is coupled to the housing, and a second end of the compression spring is coupled to the tapered cup, such that the compression spring biases the tapered cup onto the tapered post.

19. The electrical connector of claim 13, wherein the plurality of contact traces are disposed on a flexible circuit, wherein the flexible circuit is configured to wrap around an inner surface of the tapered cup.

20. An electrical connector comprising: a plurality of contact traces extending along a circumference of a tapered post, on a plurality of respective planes perpendicular to a post axis; and a tapered cup positioned over the tapered post, having a plurality of inward facing terminal contacts corresponding to the plurality of contact traces, wherein the terminal contacts are configured to maintain contact as the tapered cup rotates about the post axis, wherein one or more of the plurality of respective planes includes two or more contact traces, each extending along a separate respective portion of the circumference of the tapered post within the same plane perpendicular to the post axis, wherein the tapered post comprises a plurality of channels corresponding to a number of contact traces on the plurality of respective planes, wherein the plurality of channels are positioned on an outside surface of the tapered post and configured to align wiring coupled to the plurality of contact traces, wherein the outside surface corresponds to an outer circumference of the tapered post, and wherein the contact traces are angularly indexed with respect to the post axis, wherein one end of a first contact trace is offset along the circumference of the tapered post from a second contact trace in an adjacent plane.

* * * * *